United States Patent [19]

Taylor

[11] Patent Number: 4,876,064

[45] Date of Patent: Oct. 24, 1989

[54] CORROSION RESISTANT ZIRCONIUM ALLOYS CONTAINING BISMUTH

[75] Inventor: Dale F. Taylor, Schenectady, N.Y.

[73] Assignee: General Electric Company, Schenectady, N.Y.

[21] Appl. No.: 212,460

[22] Filed: Jun. 28, 1988

Related U.S. Application Data

[63] Continuation of Ser. No. 41,508, Apr. 23, 1987, abandoned.

[51] Int. Cl.[4] ..... C22C 16/00

[52] U.S. Cl. ..... 420/422; 148/421

[58] Field of Search ..... 420/422; 148/11.5 F, 148/12.7 B, 407, 421

[56] References Cited

U.S. PATENT DOCUMENTS

| | | | |
|---|---|---|---|
| 2,705,674 | 4/1955 | Chubb | 420/422 |
| 3,121,034 | 2/1964 | Anderko et al. | 148/11.5 |
| 4,065,328 | 12/1977 | Cheadle et al. | 148/12.7 B |
| 4,212,686 | 7/1980 | Lunde et al. | 148/11.5 |
| 4,452,648 | 6/1984 | Cheadle et al. | 148/11.5 |
| 4,649,023 | 3/1987 | Sabol et al. | 420/422 |

FOREIGN PATENT DOCUMENTS

| | | | |
|---|---|---|---|
| 854655 | 10/1970 | Canada . | |
| 859053 | 12/1970 | Canada | 420/422 |
| 136675 | 6/1986 | Japan . | |

OTHER PUBLICATIONS

Ibrahim et al., "Creep and Stress Rupture of High Strength Zirconium Alloys", Canadian Metal. Quarterly, vol. 11, No. 1, 1972, pp. 273–283.

Ito et al., "A Study on the Zirconium Alloys for Nuclear Reactor with High Strength at Elevated Temperatures", Trans. of National Research Instit. for Metals, vol. 6, No. 4, 1964, pp. 173–177.

*Primary Examiner*—Robert McDowell

*Attorney, Agent, or Firm*—James E. McGinness; James C. Davis, Jr.; James Magee, Jr.

[57] ABSTRACT

Zirconium-based corrosion resistant alloys for use primarily as a cladding material for fuel rods in a boiling water nuclear reactor which consist essentially of 0.5 to 2.5 weight percent bismuth, or alternatively, 0.5 to 2.5 weight percent of a mixture of tin and bismuth, 0.5–1.0 weight percent of a solute composed of a member selected from the group consisting of niobium, molybdenum, tellurium, and mixture thereof, alternatively, the solute will be composed of tellurium and will be in the range of 0.3–1.0 weight percent, and the balance being zirconium.

23 Claims, No Drawings

CORROSION RESISTANT ZIRCONIUM ALLOYS CONTAINING BISMUTH

This application is a continuation of application Ser. No. 041,508 filed Apr. 23, 1987, abandoned.

BACKGROUND OF THE INVENTION

1. Field of the Invention

The present invention relates to zirconium-based alloys suitable for use in nuclear reactor service, and more specifically for use in the cladding of fuel elements.

2. Description of Related Art

Zirconium-based alloys have long been used in the cladding of fuel elements in nuclear reactors. A desirable combination is found in zirconium by virtue of its low thermal neutron cross-section and its generally acceptable level of resistance to corrosion in a boiling water reactor environment. Zircaloy 2, a Zr-Sn-Ni-Fe-Cr alloy, has enjoyed widespread use and continues to be used at present in nuclear reactor applications. This alloy has provided adequate performance in reactor service, but also possesses some deficiencies which have prompted further research to find materials which would provide improved performance, Zircaloy 4 was one alloy developed as a result of that research. This alloy essentially eliminates the Ni (0.007% max. wt. percent) from a Zircaloy 2-type alloy. Zircaloy 4 was developed as an improvement to Zircaloy 2 to reduce problems with hydriding, which causes Zircaloy 2 to become brittle when cooled to ambient temperatures (e.g. when the reactor is shut down) after absorbing hydrogen at higher temperatures.

The Zircaloy alloys are among the best corrosion resistant materials when tested in water at reactor operating temperatures (approx. 290° C.) in the absence of the radiation from the nuclear fission reaction. The corrosion rate under those conditions is very low and the corrosion product is a uniform, tightly adherent, black $ZRO_2$ film/layer. In actual service, however, the Zircaloy is irradiated and is also exposed to radiolysis products present in reactor water. The corrosion resistance properties of Zircaloy deteriorate under these conditions and the corrosion rate thereof is accelerated.

Research efforts directed at improving the corrosion properties of the zirconium-based alloys have yielded some advances. Corrosion resistance has been enhanced in some instances through carefully controlled heat treatments of the alloys either prior to or subsequent to material fabrication. Added heat treatment cycles, however, generally increase the expense of making finished products, and in those instances where an installation requires welding to be performed, the area affected by the heat of the welding operation may not possess the same corrosion resistance characteristics as the remainder of the article. Variations in the alloying elements employed and the percentages of the alloying elements have also been propounded in an effort to address corrosion-resistance deterioration of these alloys.

The deterioration under actual reactor conditions of the corrosion resistance properties of Zircaloy is not manifested in merely an increased uniform rate of corrosion. Rather, in addition to the black $ZRO_2$ layer formed, a localized, or nodular corrosion phenomenon has been observed especially in boiling water reactors (BWR). In addition to producing an accelerated rate of corrosion, the corrosion product of the nodular corrosion reaction is a highly undesirable white $ZRO_2$ bloom which is less adherent and lower in density than the black $ZRO_2$ layer.

The increase rate of corrosion caused by the nodular corrosion reaction will be likely to shorten the service life of the tube cladding, and also this nodular corrosion will have a detrimental effect on the efficient operation of the reactor. The white $ZRO_2$, being less adherent, may be prone to spalling or flaking away from the tube into the reactor water. On the other hand, if the nodular corrosion product does not spall away, a decrease in heat transfer efficiency through the tube into the water is created when the nodular corrosion proliferates and the less dense white $ZRO_2$ covers all or a large portion of a tube.

Actual reactor conditions cannot be readily duplicated for normal laboratory research due to the impracticality of employing a radiation source to simulate the irradiation experience in a reactor. Additionally, gaining data from actual use in reactor service is an extremely time consuming process. For this reason, there is no conclusory evidence in the prior art which explains the exact corrosion mechanism which produces the nodular corrosion. This limits, to some degree, the capability to ascertain whether other alloys will be susceptible to nodular corrosion before actually placing samples made from these alloys into reactors.

Laboratory tests conducted under the conditions normally experienced in a reactor (absent radiation) at approximately 300° C. and 1000 psig in water, will not produce a nodular corrosion product on Zircaloy alloys like that found on Zircaloy alloys which have been used in reactor service. However, if steam is used, with the temperature increased to over 500° C. and the pressure raised to 1500 psig, a nodular corrosion product like that found on Zircaloy in reactor service can be produced on Zircaloy alloys in laboratory tests. Specimens of Zircaloy alloys which are annealed at 750° C. for 48 hours are particularly susceptible to nodular corrosion under these test conditions. These annealed Zircaloy specimens will produce, in tests run for relatively short times, i.e. 24 hours, a degree of nodular corrosion comparable to that of Zircaloy tube cladding in actual reactor service. At this higher temperature and pressure, a simulated nuclear reactor environment is provided which will allow researchers to determine the susceptibility of new alloys to nodular corrosion. Results of these tests can be generally compared to those of Zircaloy specimens tested under the same conditions.

Any new alloy which would be considered as a suitable alternate or replacement for the Zircaloy alloys must not only be less susceptible than the Zircaloy alloys to nodular corrosion, but should maintain acceptable uniform corrosion rates, to ensure sufficient service life.

It is therefore a principal object of the present invention to provide a group of alloys having improved corrosion resistance characteristics in a nuclear reactor environment.

It is another important object of the present invention to provide a group of alloys which do not depend on carefully controlled heat treatment for their corrosion resistance properties.

SUMMARY OF THE INVENTION

The present invention relates to zirconium-based alloys which, in one preferred embodiment, consist essentially of about 0.5 to 2.5 weight percent bismuth, approximately 0.5–1.0 weight percent of a solute composed of a member selected from the group consisting of molybdenum, niobium, tellurium and mixtures thereof, and the balance being zirconium.

In another preferred embodiment, the corrosion resistant alloys consist essentially of about 0.5 to 2.5 weight percent of bismuth, 0.3–1.0 weight percent of a solute composed of tellurium, and the balance zirconium.

In another preferred embodiment the amount of bismuth is in the range of about 0.7–2.0% by weight of the alloy.

In another preferred embodiment, the corrosion-resistant alloys consist essentially of about 0.5 to 2.5 weight percent of a mixture of tin and bismuth, approximately 0.5–1.0 weight percent of a solute composed of a member selected from the group consisting of molybdenum, niobium, tellurium and mixtures thereof, and the balance being zirconium.

In another preferred embodiment, the alloys consist essentially of about 0.5–2.5 weight percent of a mixture of tin and bismuth, a solute composed of tellurium and the balance zirconium.

In another preferred embodiment, the amount of the tin-bismuth mixture is in the range of 2.0–2.2 percent by weight.

In other preferred embodiments, the alloy will further consist essentially of 0.09 to 0.16 weight percent of oxygen.

In another preferred embodiment the alloy consists essentially of about 0.7–2.0 weight percent bismuth , a solute composed of niobium and molybdenum, the amount of niobium being substantially 0.5% by weight, the amount of molybdenum being substantially 0.5% by weight, and the balance zirconium.

In another preferred embodiment, the alloy consists essentially of about 0.7–2.0 weight percent bismuth, a solute composed of niobium and molybdenum, the amount of niobium being substantially 0.3 weight percent, the amount of molybdenum being substantially 0.3 weight percent, and the balance zirconium.

In another preferred embodiment, the alloy consists essentially of about 0.7–2.0 weight percent bismuth, a solute composed of niobium and tellurium, the amount of niobium being substantially 0.3 weight percent, the amount of tellurium being substantially 0.3 weight percent, and the balance zirconium.

In another preferred embodiment the alloy consists essentially of about 0.7–2.0 weight percent bismuth, a solute composed of molybdenum, tellurium and niobium, the amount of each being substantially 0.2 weight percent, and the balance zirconium.

In another preferred embodiment, the alloy consists essentially of about 2.0–2.2 weight percent of a mixture of tin and bismuth, a solute composed of niobium and molybdenum, the amount of niobium being substantially 0.3 weight percent, the amount of molybdenum being substantially 0.3 weight percent, and the balance zirconium.

In another preferred embodiment, the alloy consists essentially of about 2.0–2.2 weight percent of a mixture of tin and bismuth, a solute composed of niobium and tellurium, the amount of niobium being substantially 0.3 weight percent, the amount of tellurium being substantially 0.3 weight percent, and the balance zirconium.

In another preferred embodiment, the alloy consists essentially of about 2.0–2.2 weight percent of a mixture of tin and bismuth, a solute composed of molybdenum, tellurium and niobium, the amount of each being substantially 0.3 weight percent, and the balance zirconium.

These alloys provide increased resistance to nodular corrosion in high pressure and temperature steam testing, and will maintain acceptable uniform corrosion rates in water and steam tests.

DETAILED DESCRIPTION OF THE INVENTION

The alloys of the present invention will provide sufficient resistance to uniform corrosion to be considered invention have demonstrated improved resistance to nodular corrosion.

There are several parameters which should be considered in choosing alloying elements for the candidate Zr-based alloys to be used for fuel cladding in boiling water reactor service. The thermal neutron cross-section of the element is preferably relatively low to permit products of the fission reaction to easily pass through, the fuel rods thereby allowing the boiling water reactor to operate efficiently. The cost of the material should be taken into account, and must not be prohibitively high. The ease or difficulty with which an alloy containing the element or elements and zirconium can be produced must also be considered. It is further desired that the element or elements will enhance the corrosion resistance properties of the zirconium under actual or simulated boiling water reactor conditions.

The thermal neutron cross-section of an element is generally a known property of the element if it has ever come under consideration for use in a nuclear reactor. The costs of the materials can be ascertained from historic price data, with extrapolation if required. The alloying process of the alloys of the present invention is similar to conventional methods for alloying zirconium and thus ease of alloying is fairly predictable. The alloying is accomplished preferably by arc melting a zirconium billet having a suitable amount of the alloying metals encased in a hollow portion of the billet. This molten metal is then cast as an alloy billet, which will then be subject to finishing processes to produce final shapes.

Generally, the most difficult of these parameters to predict is whether the element will contribute to the enhancement of corrosion resistance.

The addition of tin to zirconium has been practiced in the art prior to this invention, as evidenced by Zircaloy alloys and other known zirconium-based alloy compositions. The presence of Sn, which stabilizes the $\alpha$-form of Zr, primarily contributes to the strength of the alloy, although there is some improvement in uniform corrosion resistance attributable to the Sn.

Bismuth, also an $\alpha$-stabilizer in zirconium, has received little attention from the nuclear materials community. It has been discovered in the present invention that when bismuth, or a combination of bismuth and tin are used in a zirconium-based alloy, two advantages are realized. First, bismuth has an exceptionally low thermal neutron cross-section, lower even than zirconium and tin, and much lower than most other elements commonly alloyed with zirconium.

An additional advantage is obtained when bismuth is included in a zirconium-based alloy. The presence of bismuth in alloys of this type improves resistance to nodular corrosion. It was determined in corrosion tests performed leading to the present invention that zirconium alloyed with only bismuth (or with a tin-bismuth mixture) would provide adequate protection against nodular corrosion.

It has been discovered in the present invention that the addition of certain other alloying elements to zirconium-bismuth and zirconium-tin-bismuth alloys produces alloys possessing acceptable uniform corrosion rates as well as improved resistance to nodular corrosion. More specifically, the addition of an element or mixture of elements, termed collectively herein as a solute portion of the alloy, selected from the group consisting of niobium, tellurium and molybdenum, making up about 0.5–1.0% by weight, or if tellurium alone is used, making up about 0.3–1% by weight of an alloy also containing about 0.% to 2.5% by weight of bismuth, or in the alternative containing about 0.5 to 2.5% by weight of a tin-bismuth mixture, the balance being zirconium, produces alloys which show substantial improvement in nodular corrosion resistance compared to that of Zircaloy 2. In addition to providing improved resistance to nodular corrosion, alloys having compositions in these ranges also possess the other desired features previously mentioned; i.e., low thermal neutron cross-section, and acceptable cost and ease of alloying. These alloys will also contain the conventional impurities found in sponge zirconium and zirconium alloys.

It should be noted that, in addition to the specified elements and conventional impurities, the alloys of the present invention will also optionally contain from about 0.09 to 0.16 weight percent of oxygen. Most commercial grade sponge zirconium which would be used in making alloys such as the ones in the present invention will contain small amounts of oxygen, roughly on the order of about 800–1300 parts per million. In some instances, it will be desirable to increase the concentration of oxygen in the alloy. Adding oxygen is one way to increase room temperature yield strength. Thus, the alloys of the present invention may be produced with or without the addition of oxygen, as this will have little or no effect on the corrosion resistance of the alloys.

Tests for both uniform corrosion resistance and nodular corrosion resistance have been conducted on alloys of the present invention. These tests have shown that a dramatic decrease in susceptibility to nodular corrosion can be attained in an alloy which is relatively insensitive to heat treatment, while retaining essentially the same uniform corrosion resistance of Zircaloy 2.

The alloying elements which make up the solute portion are most effective in these alloys at a total solute concentration of about 0.6–0.7 weight percent of the alloy. Solute concentrations ranging from as low as about 0.3 weight percent (when tellurium alone is used) to as high as about 1.0 weight percent have been tested and have been shown to exhibit superior resistance to nodular corrosion, compared to the performance of Zircaloy 2.

Table 1 lists several alloys which employ bismuth alone as an α-stabilizing element and one alloy which employs a tin-bismuth mixture as stabilizing elements, with various solute combinations in accordance with the present invention, along with three entries at the bottom of the table which are Zircaloy 2 alloys in three (3) different heat treatment states. These alloys were tested in water containing 8 ppm oxygen, at 288° C. and 1500 psig, conditions similar to a reactor operating temperature and pressure (minus a radiation source), to evaluate the resistance of these alloys to uniform corrosion.

It can be seen from the results in this table that the tested alloys of the present invention exhibited adequate resistance to uniform corrosion. Some of these alloys equalled or bettered the excellent performance of the Zircaloy 2 alloys. None of the specimens tested under these conditions exhibited any sign of the formation of nodular corrosion products.

Table 2 reports the results of tests conducted to determine the susceptibility to nodular corrosion of alloys containing zirconium, bismuth, and a solute according to the present invention. Tests were conducted on samples of the alloys in the as-cast form with no special heat treatment as well as on samples which were annealed at 750° C. for 48 hours. This heat treatment, as previously mentioned, is one which essentially strips the Zircaloy 2 alloy of its resistance to nodular corrosion in the laboratory steam tests. Additional tests were conducted on samples in which cast buttons were cold rolled to a 0.1 inch thickness and subsequently heat treated at either 750° C. for 48 hours or at 920° C. for three hours.

Table 3 reports the results of tests performed to determine the susceptibility to nodular corrosion of alloys containing zirconium, a mixture of bismuth and tin, and a solute according to the present invention. These tests were conducted on samples of the alloys in plate form (0.1 inch thickness). The alloys were tested in both a cold-worked state, that is, no heat treatment being performed subsequent to the plate-rolling procedure, and an annealed state wherein the samples were annealed at 750° C. for 48 hours after being rolled into plate.

The test conditions used in Tables 2 and 3 (steam at 510° C., 1500 psig) were those which induce, in the laboratory, the formation of the nodular corrosion product on Zircaloy alloys (with a 750° C./48 hour anneal) like that found on Zircaloy alloys after being used in reactor ser vice. For purposes of comparison, the weight gains seen in the annealed Zircaloy (not tabulated herein) under these same test conditions are on the order of several thousand milligrams per square decimeter.

The results reported in both Table 2 and Table 3 show that the alloys of the present invention undergo weight gains which are far superior to the weight gains evidenced in the annealed Zircaloy alloys. Most of the results were lower than 200 mg/dm$^2$, compared to the several thousand mg/dm$^2$ mentioned previously for the Zircaloy alloys. Additionally, with only one exception noted by an asterisk (*) in the table, the alloys of the present invention showed no sign of the formation of nodular corrosion products.

It can also be seen in Tables 2 and 3 that the resistance to nodular corrosion of these alloys is not highly dependent on carefully controlled heat treatment and fabrication conditions. Each composition was tested in at least two different heat treatment and/or fabrication states, and all of the resulting weight gains were far superior to those of an annealed Zircaloy alloy.

TABLE 1

OXIDE GROWTH/WEIGHT GAIN IN WATER AT 288° C., 1500 psig, 8 ppm OXYGEN

| Alloy Composition[a] | Weight Gain (mg/dm$^2$) 1000 hrs. | 1700 hrs. |
|---|---|---|
| Zr—1.4Bi—0.5Nb | 12.0 | 14.5 |
| Zr—2.0Bi—0.5Nb | 12.0 | [b] |
| Zr—0.8Bi—0.3Nb—0.3Mo | 20.5 | 32.0 |
| Zr—0.7Bi—0.5Nb—0.5Mo | 39.8 | 65.0 |
| Zr—0.66Bi—0.28Te | 11.8 | 15.0 |
| Zr—0.84Bi—0.33Te | 9.3 | 11.0 |

TABLE 1-continued

| OXIDE GROWTH/WEIGHT GAIN IN WATER AT 288° C., 1500 psig, 8 ppm OXYGEN | | |
|---|---|---|
| | Weight Gain (mg/dm²) | |
| Alloy Composition[a] | 1000 hrs. | 1700 hrs. |
| Zr—1.12Bi—0.41Te | 15.8 | 22.0 |
| Zr—1.6Bi—0.3Nb—0.3Mo | 85.0 | 150.0 |
| Zr—1.0Sn—1.0Bi—0.5Nb | 9.3 | 11.2 |
| Z2 (Zircaloy 2, cross-rolled commercial plate) | 11.3 | 13.2 |
| Z2 w/750° C./16 hr. anneal | 11.0 | 15.0 |
| Z2 w/Beta Quench | 15.0 | 17.0 |

[a]Compositions in weight percent.
[b]Test not completed.

TABLE 2

| WEIGHT GAIN AFTER EXPOSURE TO STEAM AT 510° C., 1500 psig FOR 24 HOURS | | | | |
|---|---|---|---|---|
| | Weight Gain (mg/dm²) | | Cold Rolled 0.1" | |
| Alloy Composition[1] | As Cast | 750° C./48 hr. | 750° C./48 hr. | 920° C./3 hr. |
| Zr—1.4Bi—0.5Nb | 44 | 43 | 51 | 66 |
| Zr—0.8Bi—0.3Nb—0.3Mo | 53 | 57 | 49 | 60 |
| Zr—2.5Bi—0.5Nb | 68 | 70 | 76 | 116 |
| Zr—0.7Bi—0.5Nb—0.5Mo | 53 | 81 | 56 | 116 |
| Zr—1.6Bi—0.3Nb—0.3Mo | 76 | 82 | 73 | 132 |
| Zr—1.5Bi—0.5Mo | 96 | 103 | 82 | 182 |
| Zr—1.7Bi—0.5Nb—0.5Mo | 119 | 141 | 111* | 264 |
| Zr—2.5Bi—0.5Mo | 247 | 196 | 135 | 434 |
| Zr—0.66Bi—0.28Te | 157 | 82 | 95 | |
| Zr—0.84Bi—0.33Te | 114 | 82 | 93 | |
| Zr—1.12Bi—0.41Te | 109 | 130 | 100 | |
| Zr—0.5Bi—0.5Te | 396 | 177 | | |
| Zr—1.5Bi—0.5Te | 120 | 142 | | |

[1]Compositions in weight percent.

TABLE 3

| WEIGHT GAIN AFTER EXPOSURE TO STEAM AT 510° C., 1500 psig for 24 HOURS | | |
|---|---|---|
| | Weight Gain (mg/dm²) | |
| Alloy Composition[1] | Cold Worked | 750°/48 hr. |
| Zr—1.0Bi—1.0Sn—0.5Nb | 43 | 51 |
| Zr—1.5Bi—0.7Sn—0.5Nb | 44 | 54 |
| Zr—1.0Bi—1.0Sn—0.3Nb—0.3Mo | 67 | 61 |
| Zr—1.5Bi—0.7Sn—0.3Nb—0.3Mo | 80 | 67 |
| Zr—1.0Bi—1.0Sn—0.3Nb—0.3Te | 80 | 55 |
| Zr—1.5Bi—0.7Sn—0.3Nb—0.3Te | 87 | 65 |
| Zr—1.0Bi—1.0Sn—0.2Nb—0.2Te—0.2Mo | 92 | 63 |
| Zr—1.5Bi—0.7Sn—0.2Nb—0.2Te—0.2Mo | 102 | 70 |
| Zr—1.0Bi—1.0Sn—0.6Te | 163 | 104 |
| Zr—1.5Bi—0.7Sn—0.6Te | 172 | 119 |
| Zr—1.0Bi—1.0Sn—0.5Mo | 109 | 80 |
| Zr—1.5Bi—0.7Sn—0.5Mo | 130 | 84 |

[1]Compositions in weight percent.

While other modifications of this invention and variations thereof which may be employed within the scope of the invention have not been described, the invention is intended to include such that may be embraced with the following claims.

What is claimed is:

1. A corrosion-resistant alloy consisting essentially of 0.5 to 2.5 weight percent of bismuth, 0.5–1.0 weight percent of a solute composed of a member selected from the group consisting of molybdenum, tellurium, niobium and mixtures thereof; and the balance zirconium.

2. A corrosion-resistant alloy according to claim 1 wherein the amount of solute is substantially 0.6 weight percent.

3. A corrosion-resistant alloy according to claim 2 wherein the amount of bismuth is in the range 0.7–2.0 weight percent.

4. A corrosion-resistant alloy according to claim 3 wherein the solute is composed of niobium and molybdenum, the amount of niobium being substantially 0.3% by weight and the amount of molybdenum being substantially 0.3% by weight.

5. A corrosion-resistant alloy according to claim 3 wherein the solute is composed of niobium and tellurium the amount of niobium being substantially 0.3% by weight and the amount of tellurium being substantially 0.3% by weight.

6. A corrosion-resistant alloy according to claim 3 wherein the solute is composed of molybdenum, tellurium and niobium, the amount of each being substantially 0.2% by weight.

7. A corrosion-resistant alloy according to claim 1 wherein the amount of bismuth is in the range 0.7–2.0 weight percent.

8. A corrosion-resistant alloy according to claim 9 wherein the solute is composed of niobium and molybdenum, the amount of niobium being substantially 0.5% by weight and the amount of molybdenum being substantially 0.5% by weight of the alloy.

9. The corrosion-resistant alloy of claim 1 further consisting essentially of 0.9 to 0.16% of oxygen.

10. A corrosion-resistant alloy consisting essentially of 0.5 to 2.5 weight percent of a mixture of tin and bismuth, 0.5–1.0 weight percent of a solute composed of a member selected from the group consisting of molybdenum, tellurium, niobium and mixtures thereof; and the balance zirconium.

11. A corrosion-resistant alloy according to claim 10 wherein the amount of the mixture of tin and bismuth is in the range of 2.0 to 2.2% by weight.

12. A corrosion-resistant alloy according to claim 11 wherein the amount of the solute is substantially of 0.09 to 0.16% by weight of oxygen.

13. A corrosion-resistant alloy according to claim 12 wherein the solute is composed of niobium and molybdenum, the amount of niobium being substantially 0.3% by weight and the amount of molybdenum being substantially 0.3% by weight.

14. A corrosion-resistant alloy according to claim 12 wherein the solute is composed of niobium and tellurium, the amount of niobium being substantially 0.3% by weight and the amount of tellurium being substantially 0.3% by weight.

15. A corrosion-resistant alloy according to claim 12 wherein the solute is composed of molybdenum, tellurium and niobium, the amount of each being substantially 0.2% by weight.

16. A corrosion-resistant alloy according to claim 10 wherein the amount of the solute is substantially 0.6% by weight.

17. The corrosion-resistant alloy of claim 10 further consisting essentially of 0.09 to 0.16% by weight of oxygen.

18. A corrosion-resistant alloy consisting essentially of 0.5 to 2.5 weight percent of bismuth, 0.3–1.0 weight percent of a solute composed of tellurium; and the balance zirconium.

19. A corrosion-resistant alloy according to claim 18 wherein the amount of bismuth is in the range 0.7–2.0 weight percent.

20. The corrosion-resistant alloy of claim 18 further consisting essentially of 0.09 to 0.16% by weight of oxygen.

21. A corrosion-resistant alloy consisting essentially of 0.5 to 2.5 weight percent of a mixture of tin and bismuth, 0.3–1.0 weight percent of a solute composed of tellurium; and the balance zirconium.

22. A corrosion-resistant alloy according to claim 21 wherein the amount of the mixture of tin and bismuth is in the range of 2.0 to 2.2% by weight.

23. The corrosion-resistant alloy of claim 21 further consisting essentially of 0.09 to 0.16% by weight oxygen.

* * * * *

UNITED STATES PATENT AND TRADEMARK OFFICE

CERTIFICATE OF CORRECTION

PATENT NO. : 4,876,064

DATED : October 24, 1989

INVENTOR(S) : Dale F. Taylor

It is certified that error appears in the above-identified patent and that said Letters Patent is hereby corrected as shown below:

Col. 5, line 14, delete "0.%" and substitute --0.5%--;

Col. 8, claim 8, line 38, delete "9" and substitute --7--;

Col. 8, claim 12, line 54-56, should read as follows:

--12. A corrosion-resistant alloy according to Claim 11 where the amount of the solute is substantially 0.6% by weight.--

Col. 8, claim 9, line 44, delete "0.9%" and substitute --0.09--;

Signed and Sealed this

Twenty-second Day of October, 1991

*Attest:*

HARRY F. MANBECK, JR.

*Attesting Officer*

*Commissioner of Patents and Trademarks*